US005958866A

United States Patent [19]

Donoghue et al.

[11] Patent Number: 5,958,866

[45] Date of Patent: Sep. 28, 1999

[54] SPRAY-DRIED COMPONENT COMPRISING CHELANT

[75] Inventors: Scott John Donoghue, Ixelles, United Kingdom; Achille Jules Edmond Doumen, Merchtem, Belgium

[73] Assignee: The Procter & Gamble Company, Cincinnati, Ohio

[21] Appl. No.: 09/155,161

[22] PCT Filed: Mar. 21, 1997

[86] PCT No.: PCT/US97/04651

§ 371 Date: Nov. 3, 1998

§ 102(e) Date: Nov. 3, 1998

[87] PCT Pub. No.: WO97/35953

PCT Pub. Date: Oct. 2, 1997

[30] Foreign Application Priority Data

Mar. 23, 1996 [EP] European Pat. Off. ..... 96200801

[51] Int. Cl.[6] ..... C11D 3/04; C11D 3/33; C11D 3/36

[52] U.S. Cl. ..... 510/452

[58] Field of Search ..... 510/443, 444, 510/452

[56] References Cited

U.S. PATENT DOCUMENTS

| | | | |
|---|---|---|---|
| 3,546,123 | 12/1970 | Stahlheber et al. | 252/137 |
| 4,259,200 | 3/1981 | Sims et al. | 252/102 |
| 4,666,623 | 5/1987 | May et al. | 252/545 |
| 4,764,303 | 8/1988 | Vandenbulcke et al. | 252/385 |
| 5,104,568 | 4/1992 | Shaw, Jr. et al. | 252/174.18 |
| 5,292,446 | 3/1994 | Painter et al. | 252/99 |
| 5,773,400 | 6/1998 | Baillely et al. | 510/315 |

FOREIGN PATENT DOCUMENTS

225309 A2 6/1987 European Pat. Off. .

*Primary Examiner*—Mark Kopec
*Assistant Examiner*—John R. Hardee
*Attorney, Agent, or Firm*—J. C. Rasser; B. M. Bolam; P. J. Khosla

[57] ABSTRACT

A spray-dried component which is in the form of a free-flowing particle with high chelant activity comprising: i) at least 50%, preferably at leaxt 60%, by weight, of a chelant; ii) from 1% to 25%, preferably from 5% to 10%, by weight of an alkali metal or alkaline earth metal sulfate; and iii) preferably less than 10% by weight of free moisture.

6 Claims, No Drawings

SPRAY-DRIED COMPONENT COMPRISING CHELANT

The present invention relates to a spray-dried component comprising a chelant, in particular diethylene triamine penta (methylene phosphonic acid) or its salts. Such components are useful in granular detergent products, and also as intermediate products in the manufacture of bar soap, detergent tablets and other detergent forms such as extrudates, agglomerates and the like.

U.S. Pat. No. 4,259,200, issued on Mar. 31, 1981, discloses phosphonates complexed with calcium, magnesium, zinc or aluminium ions, the molar ratio of metal ion to phosphonate being at least 1:1. It is disclosed that the magnesium and the phosphonate can be premixed in any suitable solvent, including water, optionally mixed with other detergent components and spray-dried. Improved storage stability in bleaching compositions is sought.

EP-A-0 225 309, published on Jun. 10th, 1987, discloses the addition of salts of alkali or alkaline earth metals into particles comprising diethylene triamine penta(methylene phosphonic acid) for the purpose of improving free-flow and storage properties. The amount of sulphate is 60% to 200% of the dry weight of the chelant, corresponding to a weight ratio of metal ion salt to chelant of from 0.6:1 to 2:1. Preferred water content after spray-drying is less than 10% by weight of the particle.

The prior art does not suggest that spray-dried components may be prepared having a high chelant content (at least 50% by weight) and which still maintain good free-flowing properties.

The object of the present invention is to provide a spray-dried component which is in the form of a free-flowing particle with high chelant activity.

SUMMARY OF THE INVENTION

This object is achieved by a spray-dried component comprising:

i) at least 50%, preferably at least 60%, by weight of a chelant;

ii) from 1% to 25%, preferably from 5% to 10%, by weight of a alkali metal, or alkaline earth metal sulphate; and iii) preferably less than 10% by weight free moisture.

The chelant is preferably a phosphonic or succinic acid, or salt of phosphonic or succinic acid, more preferably the chelant is selected form the group consisting of diethylene triamine penta(methylene phosphonic acid), ethylene diamine-N,N'-disuccinic acid, or mixtures, or salts thereof.

The alkaline earth metal is preferably magnesium.

DETAILED DESCRIPTION OF THE INVENTION

The spray-dried component of the present invention comprises a chelant. Chelants are used, for example in detergent compositions, for their ability to complex with metal irons such as iron and/or manganese forming soluble chelates. Suitable chelants can be selected from the group consisting of amino carboxylates, amino phosphonates, polyfunctionally-substituted aromatic chelants and mixtures thereof.

Useful amino carboxylates include ethylenediaminetetracetates ("EDTA"), N-hydroxyethylethylene diaminetriacetates, nitrilotriacetates, ethylene diamine tetraproprionates, triethylene tetraaminehexacetates, diethylenetriaminepentaacetates, and ethanoldiglycines, alkali metal, ammonium, and substituted ammonium salts thereof, and mixtures thereof.

Useful amino phosphonates include ethylenediaminetetrakis (methylenephosphonates), sold as DEQUEST®. Preferably these amino phosphonates do not contain alkyl or alkenyl groups with more than about 6 carbon atoms.

Particularly preferred chelants are diethylene triamine penta(methylene phosphonic acid) ("DTPMP") and ethylene diamine tetra(methylene phosphonic acid) (EDTMP).

Polyfunctionally-substituted aromatic chelants are also useful in the components herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelant for use herein is ethylene diamine-N,N'-disuccinate ("EDDS"), especially the [S,S] isomer as described in U.S. Pat. No. 4,704,233, issued on Nov. 3, 1987, to Hartman and Perkins.

Magnesium, aluminium or zinc sulphates are preferred for use in the present invention, magnesium sulphate being the most preferred. Epsom salts; MgSO4.7H2O, i.e. the hydrated, crystalline form of magnesium sulphate with seven moles of water is particularly preferred.

The chelants used in the present invention may be conveniently provided from commercially available sources in aqueous solution. Typical commercially available solutions have a chelant activity of from about 40% to about 60% by weight. The spray-dried component may be produced by mixing such an aqueous solution with the required amount of the sulphate, with the addition of more water if necessary to reduce total solids content, and then forming granules by spraying the solution into a conventional counter-current or co-current spray-drying tower. In the tower water is evaporated by hot gas, usually hot air, preferably to a level of less than 10% by weight of free moisture in the finished spray-dried component.

Optionally the spray-dried granules may pass through further drying and/or cooling steps in conventional process equipment, such as a fluid bed. Oversize and fines fractions are normally removed, for example, by passing the granules over vibrating screen.

Further processing including additional granulation steps, agglomeration or compaction, as well as dry mixing with other components may be to provide finished products such as detergent powders, bar soaps and tablets.

EXAMPLES

| | Example 1 | Example 2 |
|---|---|---|
| DTPMP | 80 | 84 |
| MgSO4.7H2O | 10 | 5 |
| Sodium chloride | 5 | 6 |
| Free moisture | 5 | 5 |

DTPMP is hepta sodium salt of diethylene triamine penta(methylene phosphonic acid)
MgSO4.7H2O is Epsom salts
All levels are % by weight unless otherwise specified The spray-dried component produced in these examples have a bulk density of from 500 g/l to 700 g/l. The component absorbs very little moisture after manufacture (e.g. from atmospheric humidity) and hence flowability and caking problems are minimized or eliminated even in environments of high temperature and high humidity.

What is claimed is:

1. A spray-dried component comprising:

i) a chelant, said chelant being selected from the group consisting of amino carboxylates, amino phosphonates, polyfunctionally-substituted aromatic chelants and mixtures thereof;

ii) from 1% to 25% by weight of an alkaline earth metal sulphate; and iii) free moisture characterised in that the spray dried component comprises at least 50% by weight of said chelant.

2. A spray-dried component according to claim 1 comprising:

i) at least 60% by weight of chelant;

ii) from 5% to 10% by weight of an alkaline earth metal sulphate; and iii) less than 10% by weight free moisture.

3. A spray-dried component according to claim 1 wherein the chelant is a phosphonic or succinic acid, or salt of phosphonic or succinic acid, or mixtures thereof.

4. A spray-dried component according to claim 3 wherein the chelant is selected form the group consisting of diethylene triamine penta(methylene phosphonic acid), ethylene diamine-N,N'-disuccinic acid, salts of diethylene triamine penta(methylene phosphonic acid), salts of ethylene diamine-N,N'-disuccinic acid, or mixtures thereof.

5. A spray-dried component according to claim 1 wherein the alkaline earth metal is magnesium.

6. A spray-dried component according to claim 5 wherein the alkaline earth metal sulphate is in the hydrated, crystalline form of MgSO4.7H2O.

* * * * *